United States Patent [19]

Aronowitz et al.

[11] Patent Number: 4,466,665

[45] Date of Patent: Aug. 21, 1984

[54] CHAIR HAVING ADJUSTABLE, CANTILEVERED LUMBAR-SUPPORTING ARM

[76] Inventors: Robert Aronowitz, 40 E. 84th St., New York, 10028; Bernard Katzanek, 100 Caton Ave., Brooklyn, N.Y. 11218

[21] Appl. No.: 342,574

[22] Filed: Jan. 25, 1982

[51] Int. Cl.[3] ..... A47C 7/40; A47C 7/54

[52] U.S. Cl. ..... 297/418; 297/353

[58] Field of Search ..... 297/353, 284, 418, 452, 297/460, 464, 421

[56] References Cited

U.S. PATENT DOCUMENTS

| | | | |
|---|---|---|---|
| 518,097 | 4/1894 | Derby | 297/353 X |
| 693,685 | 2/1902 | Case | 297/353 X |
| 1,074,615 | 10/1913 | Folmer | 297/464 |
| 2,281,038 | 4/1942 | JOnes | 297/353 |
| 2,619,157 | 11/1952 | Guyton et al. | 297/353 X |
| 2,838,095 | 6/1958 | Deaton | 297/421 X |
| 3,215,470 | 11/1965 | Swenson et al. | 297/353 |
| 3,471,199 | 10/1969 | Kuhlmann | 297/421 |
| 3,521,929 | 7/1970 | Pearson | 297/452 X |

FOREIGN PATENT DOCUMENTS

| | | | |
|---|---|---|---|
| 379710 | of 1964 | Switzerland | 297/418 |

*Primary Examiner*—Francis K. Zugel
*Assistant Examiner*—Peter Brown

[57] ABSTRACT

An arm chair for use in an office environment is provided including a base, a seat, upper and lower backs and a pair of arms cantilevered outwardly from the lower back. The arms, which are upholstered, are so configured as to provide lumbar support for someone sitting in the chair. The position of the arms and lower back portion are both vertically and horizontally adjustable relative to the seat.

5 Claims, 6 Drawing Figures

CHAIR HAVING ADJUSTABLE, CANTILEVERED LUMBAR-SUPPORTING ARM

BACKGROUND OF THE INVENTION

The present invention relates generally to office seating and, more particularly, to an office arm chair wherein the arm is cantilevered from the back, is adjustable relative to the seat and is adapted to provide support to the lumbar back region of a person sitting thereon at virtually any position in the chair. The chair of the present invention includes an integrally molded arm and lower back section which is adapted to provide support to the lumbar back region of a person sitting in the chair. Further, the height of the arm and lower back section is adjustable relative to the seat to permit proper positioning of the arm and lower back section.

Most arm chairs designed for use in an office seating environment utilize arms which are distinctly separate from the back and seat portions. While the backs of such chairs may, in many instances, be designed to provide lumbar support, the arms of such conventional arm chairs do not. Typically the arms of such chairs are affixed to and supported by the back and seat and are intended to serve as nothing more than a resting place for one's arms. Accordingly, the arms of such conventional chairs are normally positioned at a right angle to both the back and seat. When sitting in anything other than a "normal" position, i.e., facing forward with one's back resting against the back portion, such arms are not only uncomfortable but provide no lumbar support whatsoever. It is not uncommon for a person sitting in an arm chair to turn relative to this normal position with their back resting against the arm. In such position, no support is provided by such conventional chairs for a person's back. Moreover, such a position is uncomfortable since the perpendicular arm literally digs into the back of the person sitting therein.

The chair of the present invention, by providing cantilevered arms which are integrally formed from the lower back and which are adjustable relative to the seat, permits a person to turn in the chair and still have a degree of lumbar support.

Against the foregoing background, it is a primary objective of the present invention to provide an arm chair for use in an office seating environment which includes an integrally molded arm and lower back section.

It is another objective of the present invention to provide an arm chair for use in an office seating environment where the arms are cantilevered from the lower back.

It is still another objective of the present invention to provide an arm chair for use in an office seating environment where the arm and lower back section is adjustable relative to the seat section.

It is yet still another objective of the present invention to provide an arm chair for use in an office seating environment where the arms are so configured as to provide lumbar support for a person sitting in the chair in a position other than a straight forward "normal" sitting position.

SUMMARY OF THE INVENTION

To the accomplishments of the foregoing objects and advantages, the present invention, in brief summary, comprises an arm chair for use in an office seating environment including a base, a seat, upper and lower backs and a pair of arms integrally molded with and cantilevered from the lower back to form an arm and lower back section. The inner surface of the arms, which are preferably upholstered, is so configured as to provide lumbar support for a person sitting in the chair in virtually any position therein. The arm and lower back section is adjustable both horizontally and vertically relative to the seat.

BRIEF DESCRIPTION OF THE DRAWINGS

The foregoing and still other objects and advantages of the present invention will be more apparent from the following detailed explanation of the invention in connection with the accompanying drawings, wherein.

DETAILED DESCRIPTION OF THE PREFERRED EMBODIMENTS

Figure 1:
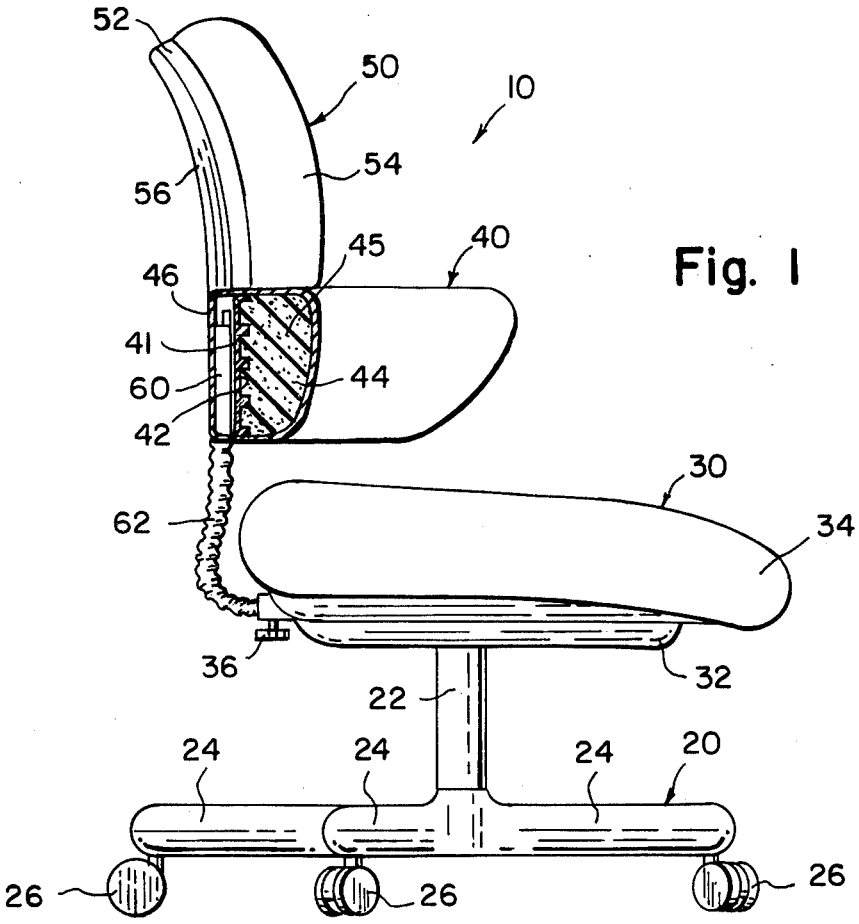
FIG. 1 is a side view of the arm chair of the present invention.
Figure 2:
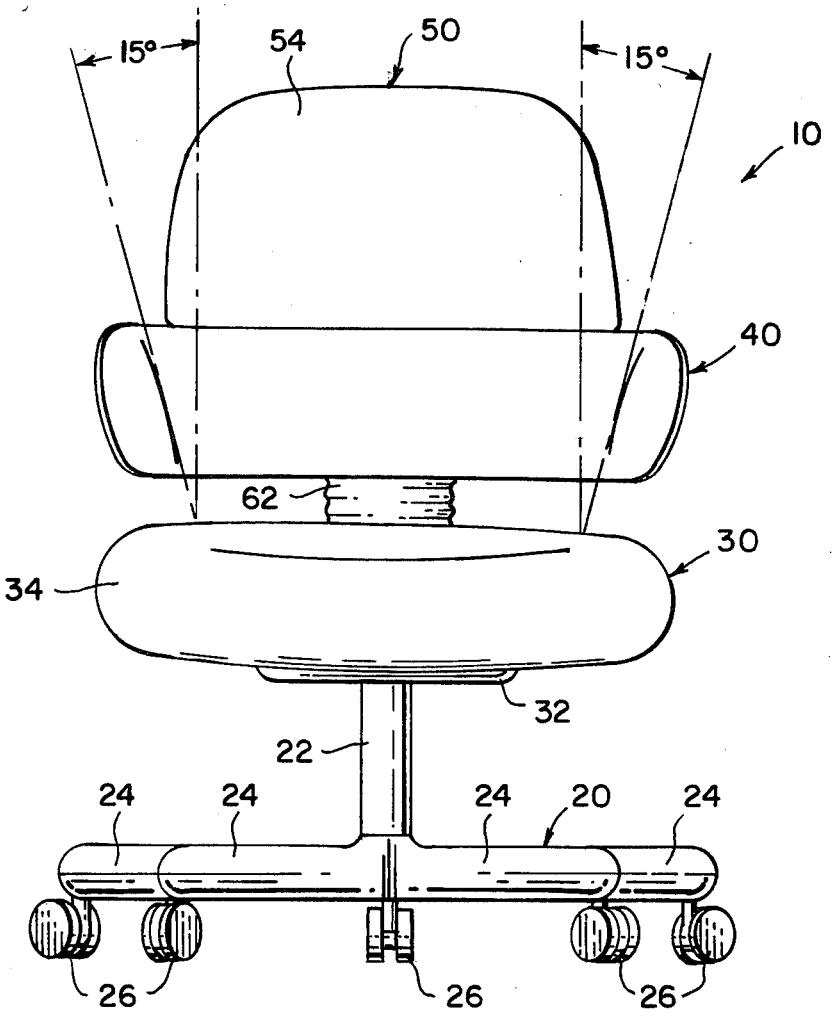
FIG. 2 is a front view thereof.

Referring now to the drawings and, in particular, to FIGS. 1 and 2 thereof, there is shown, in side elevational view, the arm chair of the present invention identified generally by reference numeral 10. Arm chair 10 is of the type including a base 20, a seat 30, an integral arm and lower back section 40 and an upper back 50.

Base 20 may be virtually any conventional swivel chair or seating base, preferably of the type depicted in FIGS. 1 and 2 having a column 22 secured to the underside of the seat 30. A plurality, preferably five, outwardly extending operational base sections 24 are provided extending from the column 22 and at least one castor 26 is mounted at the outwardly extending end of each operational base section 24. Preferably, castors 26 are of the twin or double wheel variety.

Column 22 is secured to the underside of the seat 30 of the arm chair 10 by conventional swivel means (not shown) to permit the seat 30 to swivel relative to the base 20. If desired, column 22 may include conventional internal elevational means (not shown) to permit adjustment of the height of the seat 30 relative to the floor. A particularly suitable swivel base 20 is the spin-lift mechanism marketed by Faultless.

Seat 30 is also of a generally conventional construction and, may include, for example as shown in FIG. 1, a stiff seat pan 32 supporting an upholstered seat cushion 34. Seat pan 32 may be fabricated from plywood, steel or any relatively stiff thermoplastic material. If desired, a conventional tilt mechanism (not shown) may be employed to permit the seat 30 to tilt back relative to the base 20.

The arm and lower back section 40 and upper back 50 are interconnected to the seat pan 32 of the seat 30 by a backstrap 60, preferably covered or encased by a bellows 62. The horizontal position of arm and lower back section 40 relative to the seat 30 is adjustable to accommodate a variety of different people sitting in the chair. A clamp release lever 36 is provided for locking the backstrap 60 and thus the arm and lower back section 40 in a fixed horizontal position relative to the seat 30.

Figure 3:
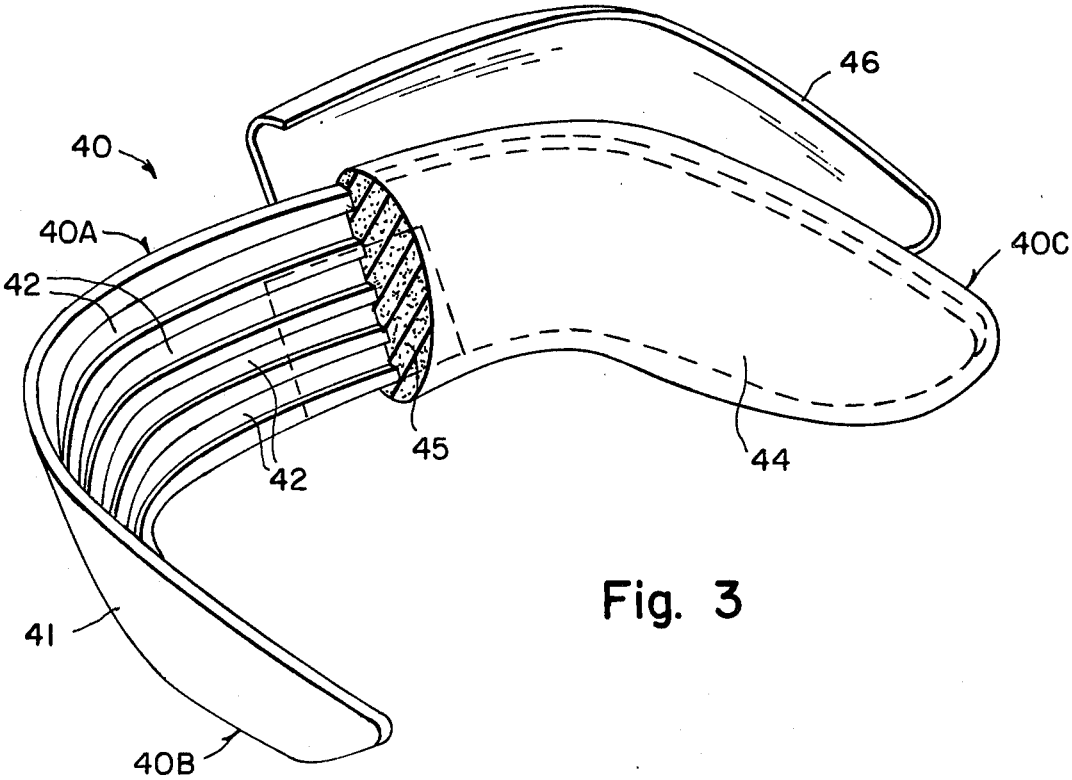
FIG. 3 is an enlarged, perspective breakaway view of the integrally molded arm and lower back section of the arm chair.

Arm and lower back section 40 is best shown in cutaway fashion in FIG. 3 and consists of a generally U-shaped, grooved, operational frame 41, preferably formed from a formed or molded thermoplastic material. As illustrated, arm and lower back section 40 constitutes an integrally formed unit wherein the two arms 40B and 40C are cantilevered from the lower back 40A and extend outwardly therefrom. A plurality of horizontally positioned grooves 42 are provided about the inner portion of the frame 41 and are adapted to facilitate the adhesive bonding thereto of an upholstered cushion 44. An outer or exterior skin 46, preferably fabricated from a thermoplastic material, is further provided around the outer surface of frame 41 overlaying the edge of the upholstered cushion 44 to provide a protective cover therefore.

Upholstered cushion 44 is preferably formed from a urethane foam 45 and is so configured around the inner portion of arm and lower back section 40 so as to provide support to the lumbar back region of a person sitting in the chair in virtually any position. Such support is effected by configuring the inner surface of the lower back 40A and arms 40B and 40C such that it forms an angle of between about 10° and about 20° relative to a vertical line drawn perpendicularly from the seat 30. A particularly prefered angle for the inner surface of arms 40B and 40C and lower back 40A relative to such perpendicular line is about 15°. In this manner, it has been found that when the inner surfaces of the arms 40B and 40C and lower back 40A are so configured, support is provided for the lumbar back region of a person sitting in the chair no matter what position he or she may be sitting in.

A separate and distinct upper back 50 is further provided consisting of a molded frame 52, preferably of plywood, an upholstered cushion 54 secured to the inner surface of the molded frame 52 and an exterior skin 56 secured to and covering the outer surface of the frame 52. Upper back 50 is secured or otherwise affixed to arm and lower back section 40 by suitable securing means and therefore moves vertically and horizontally with the arm and lower back section 40.

Figure 4:
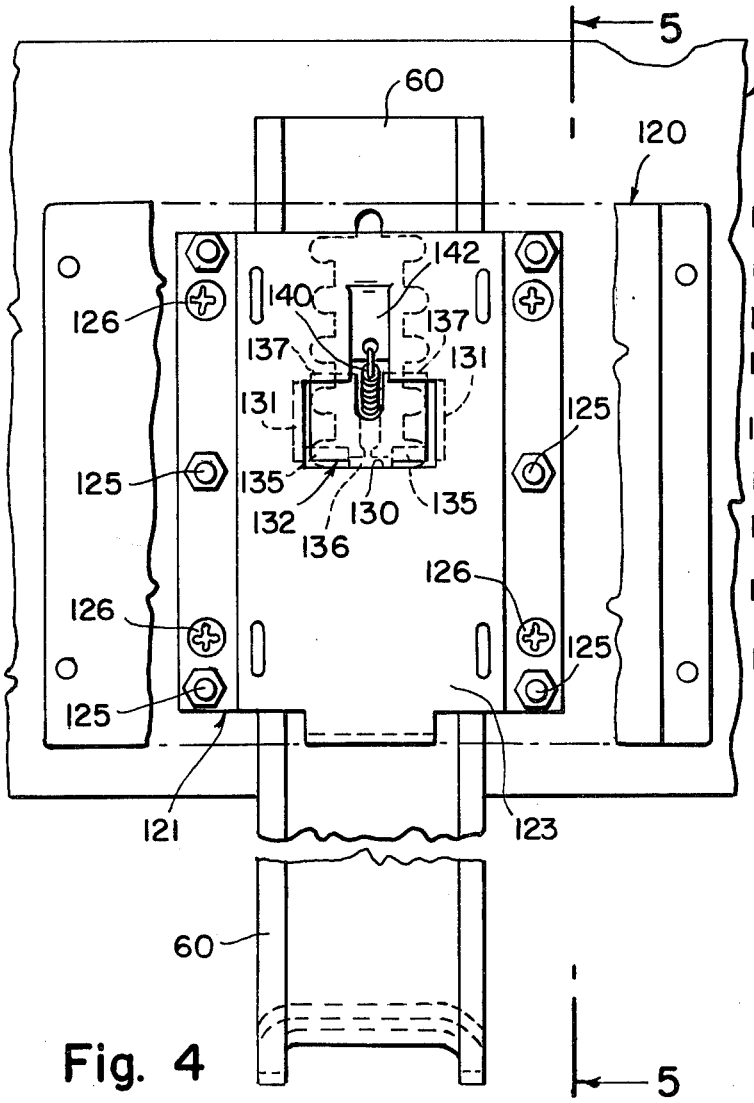
FIG. 4 is a fragmentary elevational view of a portion of a preferred height adjustment mechanism which could be utilized to adjust the height of the arm and lower back section of the armchair of the present invention relative to the seat.
Figure 5:
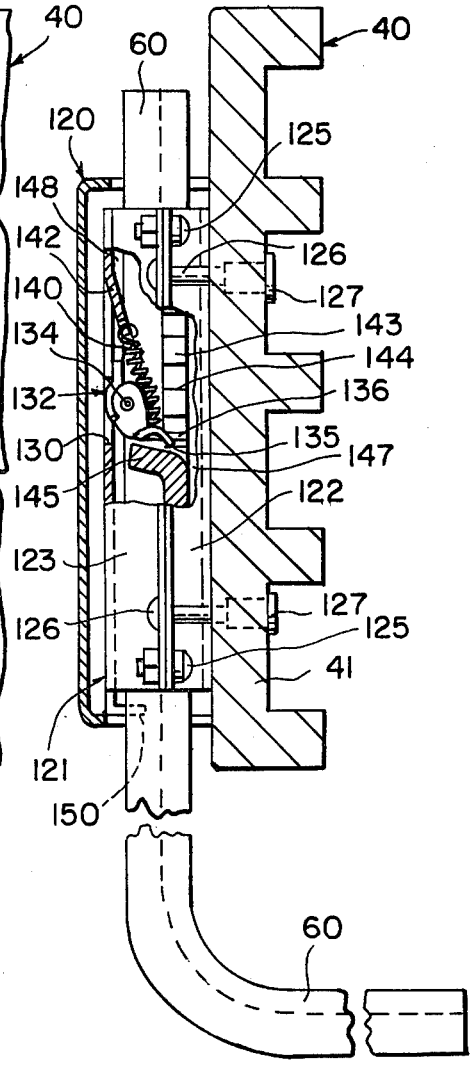
FIG. 5 is a sectional view taken along line 5—5 of FIG. 4.
Figure 6:
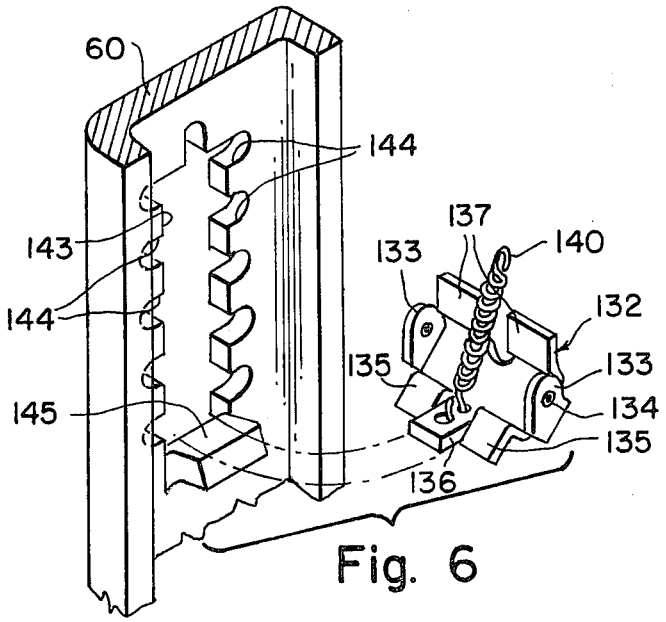
FIG. 6 is an enlarged fragmentary perspective view of a portion of a preferred height adjustment mechanism which could be utilized in the arm chair of the present invention showing the vertically extending notches along the upper portion thereof.

The height of arm and lower back section 40 and the upper back 50 relative to the seat 30 are adjustable by back height adjustment means 120. A particularly preferred back height adjustment apparatus 120 is depicted in FIGS. 4–6 and is described in greater detail in copending, commonly assigned, U.S. patent application Ser. No. 330,280 filed on Dec. 14, 1981 in the name of Wayne C. Seeley, entitled BACKREST HEIGHT ADJUSTMENT FOR OFFICE CHAIR, the disclosure of which is hereby expressly incorporated herein by reference thereto.

Stated briefly, the preferred back height adjustment apparatus 120 includes a housing 121 with stamped front and rear housing plates 122 and 123. Nut and bolt assemblies 125 secure these plates to each other. Housing 121 is secured to the arm and lower back 40 by screws 126 which extend into the frame 41 and are secured by nuts 127. Front plate 123 includes an inverted T-shaped cutout 130 and opposite sides of the cutout 130 are bent inwardly to form a pair of pivot plates 131.

A pawl, broadly indicated at 132, is provided with a pair of side pivot plates 133 which are positioned inside of the pivot plates 131 of the housing 121 and are pivotally connected thereto, as indicated at 134 in FIG. 5, so that the pawl 132 is pivotally connected to the housing 121. The lower end portion of the pivot pawl 132 is provided with a pair of downwardly angled ratchet fingers 135 and an operating tongue 136 extending outwardly between the ratchet fingers 135. The upper end of the pivot pawl 132 is provided with a pair of upstanding stop legs 137.

Tension spring 140 is connected at its lower end to holes provided in the tongue 136 of the pawl 132. The upper end of the spring 140 is suitably connected to the lower end of an inwardly bent portion of the front plate 123, forming a spring perch 142, which may be bent inwardly and outwardly to adjust the position of the upper end of the spring 140.

The upper end portion of the backstrap 60 is provided with notch means extending vertically therealong and is illustrated as including a slot 143 with spaced notches 144 extending along opposite sides thereof. The tongue 136 of the pawl 132 is adapted to ride in the slot 143 and ratchet fingers 135 are adapted to engage the notches 144 when the arm and lower back 40 section is moved upwardly when the pawl 132 is in the operative position. The lower end of the notch means is provided with an inwardly curved cam member 145 which forms a part of the pivot pawl operator means.

The backstrap 60 is provided with forwardly bent flanges at each side thereof to lend rigidity thereto. Rear slide guide bars 147 are supported in the rear plate 122 and slidably engage the rear portion of the backstage 60. Slide guide bars 148 are supported in the front plate 123 and engage the front edges and sides of the backstrap 60. Guide bars 147 and 148 are formed of a suitable plastic material so that the housing 121 is supported for free vertical sliding movement on the backstrap 60.

Operator means associated with the upper and lower ends of the notch means are adapted to be engaged by the pawl 132 and to switch the same between the operative and inoperative positions. When the housing 121 and the arm and lower back section 40 are raised from the lowermost position, as shown in FIG. 4, the ratchet fingers 135 are resiliently cammed up the notches 144 by the tension spring 140 which is forward of the pivot point 134 of the pawl 132. When the arm and lower back section 40 is raised, the ratchet fingers 135 will resiliently engage the notches 144 and the pawl 132 will move in a counterclockwise direction. When the desired level is reached, the lower ends of the ratchet fingers 135 will engage the bottom of the notch 144 and the stop legs 137 will engage the inner surface of the front plate 123 and maintain the arm and lower back section 40 in the adjusted position.

If it is desired to lower the arm and lower back section 40 from a previously adjusted position, it is raised to the uppermost position where an inwardly bent stop 150 engages cam member 145. As the housing 121 reaches this uppermost position, the tongue 136 of the pawl 132 engages the upper end of the slot 143 and the pawl 132 is moved a sufficient distance in a clockwise direction so that the longitudinal axis of the spring 140 will be positioned rearwardly of the pivot point 134 of the pawl 132. The spring 140 will then switch the paul 132 to the inoperative position and the arm and lower back section 40 and the housing 121 can then be lowered down the backstrap 60.

As the arm and lower back section is lowered to the lowermost position, the tongue 136 of the pawl 132 engages the cam member 145, causing the pawl 132 to move in a counterclockwise direction so that the longitudinal axis of the spring 140 then moves forwardly of the pivot point 134 to switch the pawl 132 to the operative position. The spring 140 resiliently urges the pawl 132 in a counterclockwise direction with the downwardly angled upper surfaces of the ratchet fingers 135 in position to engage and ride up the notches 144 when the lower back and arm 40 is again raised. When raised to the desired position, the lower ends of the ratchet fingers 135 will engage and be supported on the corresponding notches 144 and support the arm and lower back section 40 in the adjusted position.

Thus, the pawl 132 is resiliently maintained in the operative position with the ratchet fingers 135 being resiliently urged against the notches 144, when the arm and lower back section 40 is being raised. Upon reaching the upper end of the slot 143, the pawl 132 is switched to the inoperative position with the ratchet fingers 135 out of engagement with the notches 144. With the longitudinal axis of the spring 140 positioned rearwardly of the pivot point 134 of the pawl 132, the pawl 132 is resiliently maintained in the inoperative position and the arm and lower back section 40 and the housing 121 are then moved to the lowermost position to reset the pawl 132 in the operative position in preparation for making a subsequent vertical adjustment of the arm and lower back section 40.

When it is desired to adjust the arm and lower back section 40 upwardly from any given adjusted position, it is merely necessary to lift it to the desired position. If it is desired to lower it below a previously adjusted position, the arm and lower back section 40 is first raised to its uppermost limit to switch the pawl 132 to the inoperative position. It is then moved to its lowermost position to reset the pawl 132 to the operative position. Then, the arm and lower back section 40 is raised to the desired position and maintained in the adjusted position. These up and down movements of the arm and lower back section 40 can be easily made by a person while in the normal sitting position.

It will thus be appreciated that arm chair 10 is intended to be readily adjustable to provide adequate support for anyone sitting thereon in virtually any position. To this effect, not only is the arm and lower back section 40 so configured as to provide lumbar support in virtually any seating position, its height and distance relative to the seat 30 are also adjustable to accommodate different people.

Having thus described the invention with particular reference to the preferred forms thereof, it will be obvious that various changes and modifications may be made therein without departing from the spirit and scope of the invention as defined in the appended claims.

What is claimed is:

1. An arm chair having a base, a seat, a back and a pair of arms extending horizontally above said seat and cantilevered from said back, the inner surface of said arms forming an angle between about ten and twenty degrees relative to a vetical line drawn perpendicularly from said seat thereby providing lumbar support for a person sitting in said chair, and means for adjusting the height of said arms relative to said seat.

2. The arm chair of claim 1 wherein said back includes upper and lower back portions and wherein said pair of arms are integrally formed from said lower back portion.

3. The arm chair of claim 1 wherein said angle is about 15°.

4. The arm chair of claim 1 wherein said back is connected to said seat by a backstrap.

5. The arm chair of claim 1 wherein the horizontal distance between said back and said seat is adjustable.

* * * * *